US010875703B2

(12) United States Patent
Fei et al.

(10) Patent No.: US 10,875,703 B2
(45) Date of Patent: Dec. 29, 2020

(54) COMPACT LIQUID SPRAYING BOTTLE FILLED LIQUID FROM THE BOTTOM

(71) Applicant: CHANGZHOU IVORIE SHENGMEI PACKAGING TECHNOLOGY CO., LTD., Jiangsu (CN)

(72) Inventors: Xiaoming Fei, Jiangsu (CN); Zhipei Gu, Jiangsu (CN)

(73) Assignee: CHANGZHOU IVORIE SHENGMEI PACKAGING TECHNOLOGY CO., LTD., Changzhou (CN)

( * ) Notice: Subject to any disclaimer, the term of this patent is extended or adjusted under 35 U.S.C. 154(b) by 158 days.

(21) Appl. No.: 16/074,095

(22) PCT Filed: Jan. 26, 2018

(86) PCT No.: PCT/CN2018/074301
§ 371 (c)(1),
(2) Date: Jul. 31, 2018

(87) PCT Pub. No.: WO2018/227979
PCT Pub. Date: Dec. 20, 2018

(65) Prior Publication Data

US 2020/0087054 A1 Mar. 19, 2020

(30) Foreign Application Priority Data

Jun. 16, 2017 (CN) ..... 2017 1 0457160

(51) Int. Cl.
*B65D 83/42* (2006.01)

(52) U.S. Cl.
CPC ..... *B65D 83/425* (2013.01); *B65D 2205/02* (2013.01)

(58) Field of Classification Search
CPC .. B65D 83/425; B65D 2205/02; B65D 47/32; B05B 11/0005; B05B 11/0035;
(Continued)

(56) References Cited

U.S. PATENT DOCUMENTS 3,559,701 A * 2/1971 Wittersheim ..... B65D 83/14 141/20
9,259,752 B2 * 2/2016 Dumont ..... B05B 11/0056
(Continued)

FOREIGN PATENT DOCUMENTS

CN 103213767 A * 7/2013 ..... B05B 11/0056
CN 103213767 A 7/2013
(Continued)

OTHER PUBLICATIONS

CN-103213767-A_English_Translation_of_Specification (Year: 2013).*
(Continued)

*Primary Examiner* — Marina A Tietjen
*Assistant Examiner* — Stephanie A Shrieves

(57) ABSTRACT

The invention relates to the technical field of spraying bottles with bottoms filled with liquid, in particular to a compact liquid spraying bottle with a bottom filled with liquid. The compact liquid spraying bottle comprises a spraying head, a bottle body and a liquid filling and exhaust function assembly arranged at the bottom of the bottle body, wherein the liquid filling and exhaust function assembly comprises a valve core, a valve bush, a valve seat and a tail cover which are matched jointly to realize liquid filling and exhaust functions. The liquid filling and exhaust function assembly of the invention has a relatively good sealing property on the whole and a relatively compact structure, so that the occupied space of a function area is reduced, the containing space of effective liquid is increased, and the degree of satisfaction of customer use is improved.

7 Claims, 8 Drawing Sheets

(58) Field of Classification Search
CPC ..... B05B 11/00446; B05B 11/0097; B05B 11/0056; F16K 24/00; F16K 3/22; F16K 3/26; F16K 3/243
USPC ..... 141/113; 251/142, 149, 149.6, 149.1; 137/625.25, 588
See application file for complete search history.

(56) References Cited

U.S. PATENT DOCUMENTS

| | | | | |
|---|---|---|---|---|
| 9,738,437 | B2 * | 8/2017 | Hui | B05B 11/00442 |
| 2013/0126639 | A1 * | 5/2013 | Tu | B05B 11/0056 239/302 |
| 2014/0175129 | A1 * | 6/2014 | Croibier | B05B 11/0097 222/321.9 |
| 2015/0047741 | A1 * | 2/2015 | Wong | A45D 34/00 141/113 |
| 2016/0137393 | A1 * | 5/2016 | Hui | B05B 11/0056 222/397 |
| 2016/0279654 | A1 * | 9/2016 | Tu | B05B 11/0056 |
| 2017/0100733 | A1 * | 4/2017 | Okhai | B05B 11/0038 |

FOREIGN PATENT DOCUMENTS

| | | | | | |
|---|---|---|---|---|---|
| CN | 203268687 | U | * | 11/2013 | B05B 11/0056 |
| CN | 203428253 | U | * | 2/2014 | B05B 11/0056 |
| CN | 104029925 | B | * | 5/2016 | B05B 11/0056 |
| CN | 104029925 | B | | 5/2016 | |
| EP | 2862632 | B1 | * | 6/2016 | B05B 11/0056 |
| WO | WO-1994003380 | A1 | * | 2/1994 | |
| WO | WO-2011064115 | A1 | * | 6/2011 | B05B 11/0097 |

OTHER PUBLICATIONS

CN-104029925-B_English_Translation_of_Specification (Year: 2016).*
CN-203428253-U_English_Translation_of_Specification (Year: 2014).*
CN-203268687-U_English_Translation_of_Specification (Year: 2013).*
WO-2011064115-A1_English_Translation_of_Specification (Year: 2011).*

* cited by examiner

COMPACT LIQUID SPRAYING BOTTLE FILLED LIQUID FROM THE BOTTOM

FIELD OF THE INVENTION

The invention relates to the technical field of spraying bottles filled with liquid, in particular to a compact liquid spraying bottle filled liquid from the bottom.

BACKGROUND ART

The invention is an improvement of the company's second-generation product technology.

The company's second-generation product has obtained the patent for invention with the publication number being CN104029925B. The specific content is as follows: a novel detachable filling type liquid spraying bottle comprises a bottle body and a bottle bottom on the whole, wherein the bottle body and the bottle bottom are detachably connected by a valve seat; the valve seat is integrated; positioning ribs, sealing grooves, and a concave and convex toothed structure are arranged on the outer wall of the valve seat, and the to connect with bottle body; the outer wall of the valve seat is provided with threads to be connected with the bottle bottom simultaneously; a valve seat liquid inlet hole and a valve seat exhaust hole are also formed in the valve seat; a high column and a low column are respectively arranged at the two sides of the valve seat and are of hollow structures, cavities are formed in the high column and the low column, the cavity communicated with the valve seat liquid inlet hole is the liquid inlet cavity, and the cavity communicated with the valve seat exhaust hole is the exhaust cavity which is communicated with the exhaust pipe simultaneously; the valve core is inserted in the inner cavity of the valve seat and is designed to be of an asymmetric structure on the whole; the inner cavity of the valve seat and the outer contour of the valve core are matched with each other in shape; and as the valve seat is of an asymmetric structure on the whole, the valve core can only be inserted into the inner cavity of the valve seat in a unique manner; a spring is arranged between the top end of the valve core and the inner cavity; and a through hole is formed in the valve core and communicated with a liquid inlet on the wall surface of the middle section of the valve core; a sealing ring I is arranged between the valve core and the valve seat liquid inlet hole; a sealing ring II is arranged between the valve core and the valve seat exhaust hole; during working, after the spring is compressed by an external force, an airtight liquid inlet passage is formed between the sealing ring I and the sealing ring II and communicated with the valve seat liquid inlet hole; an exhaust passage is formed by the lower part of the sealing ring II and the gap between the valve core and the inner cavity of the valve seat; and after the spring is compressed by the external force, the exhaust passage is communicated with external atmospheric environments. The liquid spraying bottle is convenient to carry, dismantle and clean, has a good sealing property, can prevent followed rotation, is simple in production technology, and can be circularly filled with liquid and be repeatedly utilized, and is filled with different gases without tainting by odor.

Our second-generation products have been produced for more than two years, and some problems occur in the production process. The problems urgently need to be solved through improved new structures. The specific problems are as follows:

(1) a liquid filling port and an exhaust port are round and need to be manually trepanned; it is difficult to ensure the accuracy of the trepanning position and the diameter size of the trepanning; the production efficiency is low; and the product rate is low;

(2) as the valve core is of a non-circular symmetrical structure, the oriented installation is needed, the installation efficiency is low, and the whole liquid filling passage and the whole exhaust passage are excessively complicated;

(3) the design precision of the valve seat and the valve core is insufficient; the injection molding shrinkage affects homogeneous deformation degree; the product rate is low; and lots of production problems are caused;

(4) the structure is loose; the liquid filling and exhaust function assembly has large volume, small liquid containing space and inaesthetic appearance, and the customer is not satisfied with the product.

(5) an O-shaped sealing ring is adopted in the past, and suffers extrusion deformation during installation, and therefore, the passing rate of the O-shaped sealing ring in the pressure testing is low.

In view of the above problems, the company has carried out a new renovation of the liquid spraying bottle.

SUMMARY OF THE INVENTION

In order to overcome the shortcomings of the prior art, the invention provides a compact liquid spraying bottle filled liquid from the bottom, which has the advantages of simple and fast liquid filling and exhaust process, and meanwhile has a relatively compact structure.

The technical scheme adopted by the invention for solving the technical problems is as follows: a spraying bottle with a bottom filled with liquid comprises a spraying head assembly, a bottle body and a liquid filling and exhaust function assembly arranged at the bottom of the bottle body, wherein the spraying head assembly is arranged at the upper part of the bottle body; and the liquid filling and exhaust function assembly comprises a valve core, a valve bush, a valve seat and a tail cover which are matched jointly to realize liquid filling and exhaust functions; the valve core is inserted in the valve bush; a spring is arranged between the top end of the valve core and the inner cavity of the valve bush; during liquid filling, the valve core moves upwards in the valve bush and resets through the spring; the valve seat is sleeved at the outer side of the valve bush; a gap is reserved at a lower end of a connected part of the valve bush and the valve seat; and the tail cover is inserted in the gap.

According to another embodiment of the invention, further, a liquid filling process and an exhaust process are respectively as follows:

the liquid filling process: a valve core liquid inlet through hole is formed in the valve core, and a valve core liquid filling port is formed in the side wall of the valve core and is communicated with the valve core liquid inlet through hole; a valve bush liquid filling port is formed in the valve bush and is communicated with the interior of the bottle body; during stillness, the valve bush liquid filling port is sealed by the valve core; during liquid filling, the valve core moves upwards in the valve bush, the valve bush liquid filling port is opened and is communicated with the valve core liquid filling port through a recess formed in the valve core, so that liquid enters the valve core liquid filling port from the valve core liquid inlet through hole, enters the valve bush liquid filling port through the recess and then directly enters the interior of the bottle body;

the exhaust process, a valve seat exhaust hole is formed in the valve seat, and an exhaust pipe is connected to the valve seat exhaust hole in a sealing manner and is communicated with upper gas of the bottle body; the top surface of the tail cover is provided with a ring of discontinuous tail cover convex ribs narrower than the width of the top surface of the tail cover, and an exhaust gap I is formed between the top end of the tail cover and the lower surface of the valve seat; longitudinal ribs are arranged on the outer wall of the inner ring of the tail cover and cause an exhaust gap II to be formed between the inner ring and the valve bush; the exhaust pipe, the valve seat exhaust hole, the exhaust gap I, the valve bush exhaust port and the exhaust gap II are communicated from head to tail to form an exhaust passage jointly; during stillness, the valve bush exhaust port is sealed by the lower half part of the valve core, the exhaust passage is obstructed, during liquid filling, the valve core moves upwards in the valve bush, the valve bush exhaust port is opened, the exhaust passage is communicated with an exhaust notch at the bottom of the tail cover, and the exhaust notch is naturally communicated with atmosphere.

According to another embodiment, further, the valve core is of an integrated structure and comprises an upper convex ring for sealing the valve bush liquid filling port, a low convex ring for sealing the valve bush exhaust port, an inner sleeve located in the low convex ring and provided with the valve core liquid inlet through hole, and a silica gel cushion located in the valve core liquid inlet through hole and provided with a through hole; The recess for filling liquid is formed between the upper convex ring and the low convex ring, and the valve core liquid filling port is formed in the middle position of the recess.

According to another embodiment, further, the valve core is also provided with a sealing groove and an O-shaped sealing ring which are used for enhancing the sealing of the valve bush liquid filling port.

According to another embodiment, further, the valve bush is of an integrated structure and comprises a barrel-shaped valve bush shell, a valve bush limiting column located in the center of the inner top surface of the valve bush shell and used for defining the up stroke of the valve core, the valve bush liquid filling port located in the middle of the valve bush shell, and the valve bush exhaust port located below the valve bush liquid filling port; and a first sealing ring groove and a second sealing ring groove are respectively formed in the two sides of the valve bush exhaust port.

According to another embodiment, further, the valve seat is of an integrated structure and comprises a holding frame used for assembling the valve bush, a valve seat table connected to the bottle body and the exhaust hole for installing the exhaust pipe, wherein a step connected to the bottle body in a clamping manner is arranged on the side surface of the valve seat table, and the lower part of the valve seat table is provided with a lantern ring connected to the tail cover.

According to another embodiment, further, the tail cover is of an integrated structure and comprises an outer ring provided with tail cover convex ribs, and an inner ring used for limiting the down stroke of the valve core and provided with longitudinal ribs on the periphery of the outer wall, and an exhaust notch is formed at a connected bottom of the outer ring and the inner ring.

According to another embodiment, further, holes of the valve core liquid filling port, the valve bush liquid filling port and the valve bush exhaust port are rectangular or ovaloid and prolate.

The invention has the beneficial effects that:

(1) The brand-new structure and combination manner are adopted in the present invention, the structure is symmetrical and concise, and the injection molding shrinkage ratio is uniform, thus causing the sealing property of the liquid filling and exhaust function assembly to be relatively reliable, the assembly to be relatively simple and convenient and the whole bottle to be relatively compact, greatly reducing the occupied space of function areas and increasing the effective liquid containing space; the appearance of the spraying bottle of this invention is relatively aesthetic; and the degree of satisfaction of the customer use is improved.

(2) A brand new multiple-gap combined exhaust passage is adopted in the present invention, and compared with the company's second generation products and other prior art, the compact liquid spraying bottle with the bottom filled with liquid is very different, and is relatively smooth in the whole exhaust process.

(3) Due to adoption of the brand-new valve core structure, the compact liquid spraying bottle with the bottom filled with liquid has a relatively good sealing property, and the assembly of the compact liquid spraying bottle with the bottom filled with liquid is relatively simple and reliable.

(4) The present invention provides a new valve bush creatively and additionally; and the valve bush liquid filling port and the valve bush exhaust port are molded by injection, so that the stability and accuracy of the size are ensured.

(5) All parts of the liquid filling and exhaust function assembly of the compact liquid spraying bottle with the bottom filled with liquid are connected to one another by adopting multiple combination manners of buckle ribs, sealing ribs and an O-shaped sealing rings, so that the compact liquid spraying bottle with the bottom filled with liquid is convenient to manufacture by a worker, the product rate is high, and the fast passing of the compact liquid spraying bottle with the bottom filled with liquid in the pressure test is facilitated.

BRIEF DESCRIPTION OF THE DRAWINGS

The invention will be further illustrated below in conjunction with accompanying drawings and embodiments.

DESCRIPTION OF THE EMBODIMENTS

Figure 1:
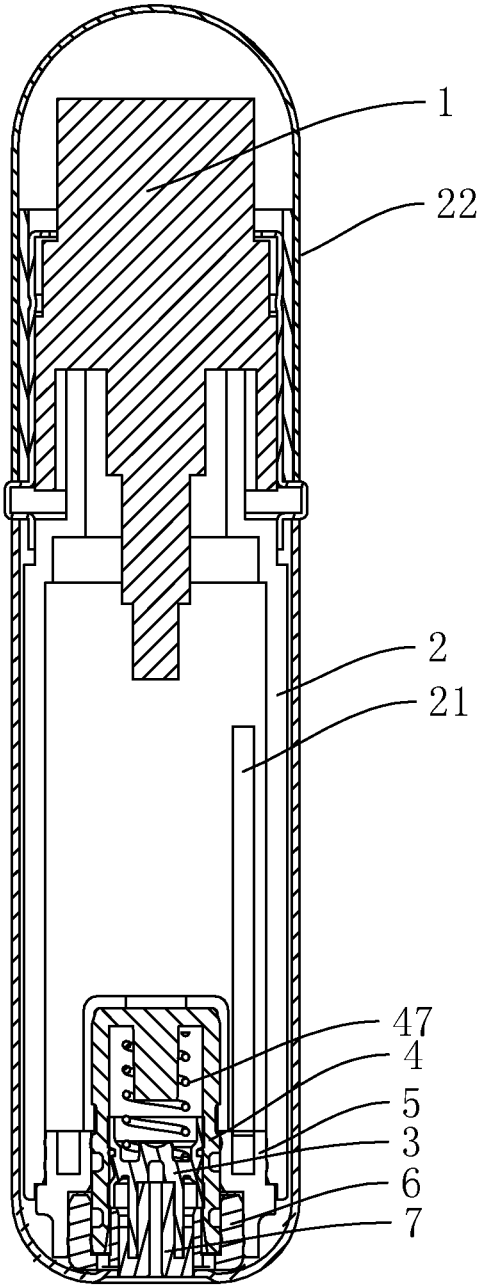
FIG. 1 is a schematic diagram of an overall structure of a liquid spraying bottle.

As shown in FIG. 1, a compact liquid spraying bottle filled liquid from the bottom comprises a spraying head assembly 1, a bottle body 2 and a liquid filling and exhaust function assembly arranged inside the bottle body 2. The spraying head assembly 1 is arranged at the upper part of the bottle body 2. In addition, the metal piece bottle bush 22 can be additionally arranged on the exterior of the bottle body 2; and a plastic or/and metal bottle cover can be additionally arranged at the upper part of the bottle body 2, and is connected to the bottle body 2 in a ferrule or friction manner.

As shown in FIG. 1, the liquid filling and exhaust function assembly comprises a valve core 3, a valve bush 4, a valve seat 5 and a tail cover 6 which are matched jointly to realize liquid filling and exhaust functions. The valve core 3 is inserted in the valve bush 4; a spring 47 is arranged between the top end of the valve core 3 and the inner cavity of the valve bush 4; during liquid filling, the valve core 3 moves upwards in the valve bush 4 and resets through the spring 47; the valve seat 5 is sleeved at the outer side of the valve bush 4; a gap is reserved at a lower end of a connected part of the valve bush 4 and the valve seat 5; and the tail cover 6 is inserted in the gap.

Figure 2:
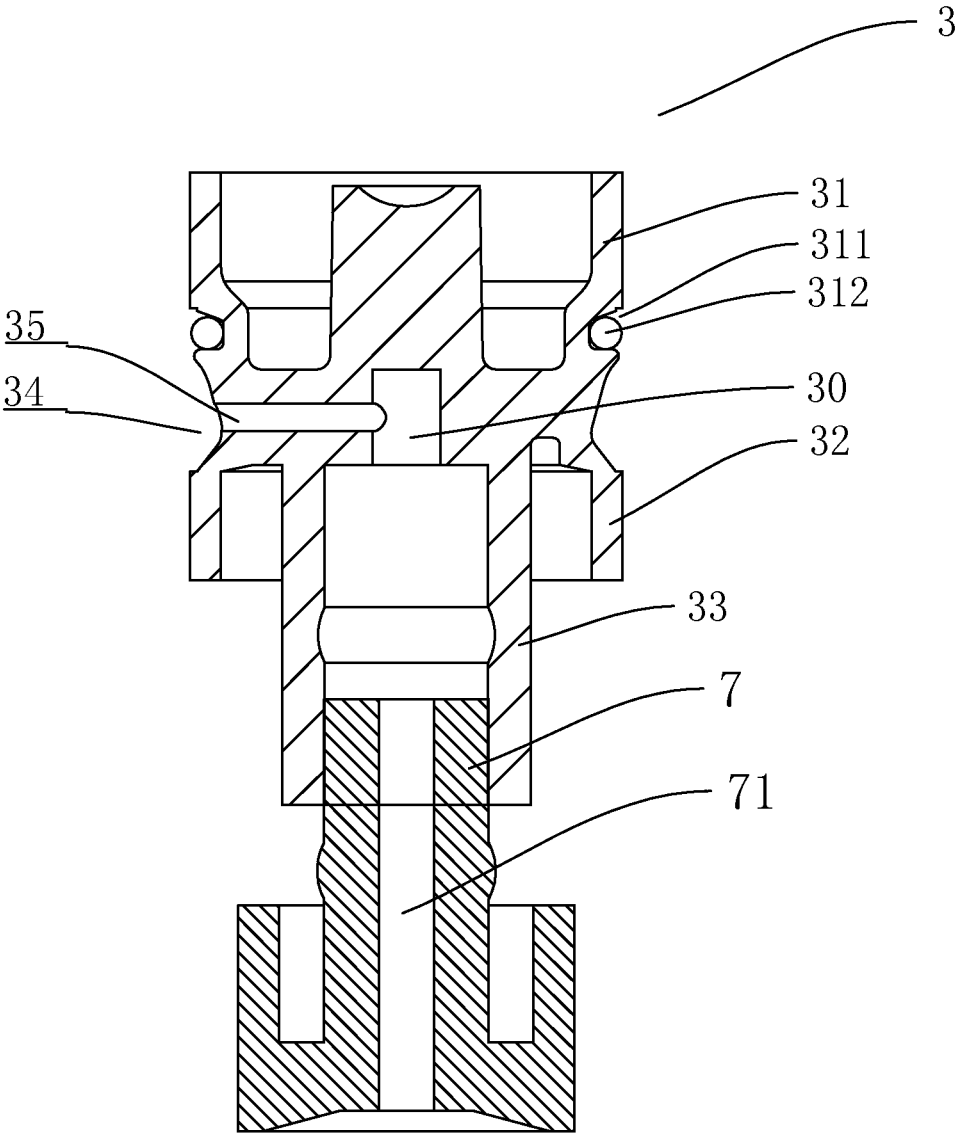
FIG. 2 is a sectional diagram of a structure of a valve core.

FIG. 2 is the structure of the valve core 3 of the invention. The valve core 3 is of an integrated structure. The valve core 3 comprises an upper convex ring 31 and a lower convex ring 32. The upper convex ring 31 seals the valve bush liquid filling port 45 at an initial position of liquid filling. A valve core limiting column is arranged in the upper convex ring 31, is matched with a limiting column of the valve bush 4 and is used for defining the up stroke of the valve core 3. The valve core limiting column can be omitted, and the omitting of the valve core limiting column does not affect the realization of the liquid filling function of the valve core 3. Meanwhile, the spring 47 is sleeved on the limiting column of the valve core 3 and has a reset function; and when the valve core 3 lifts to the stop position of the up stroke and is free of external pressure, the spring 47 resets the valve core 3 to the initial position of liquid filling. When the valve core limiting column is omitted, the spring 47 can be sleeved on the valve bush limiting column 42. A sealing groove 311 and an O-shaped sealing ring 312 are arranged below the upper convex ring 31 and are used for enhancing the sealing of the valve bush liquid filling port 45. The lower convex ring 32 is used for sealing the valve bush exhaust port 46 during the initial position of liquid filling. An inner sleeve 33 is arranged in the lower convex ring 32, and a valve core liquid inlet through hole 30 is formed in the inner sleeve 33. A ring of recess 34 for filling liquid is formed along the periphery between the upper convex ring 31 and the low convex ring 32, and the valve core liquid filling port 35 is formed in the middle position of the recess 34. The valve core liquid filling port 35 can be in any shape; and preferably, the valve core liquid filling port 35 is rectangular or ovaloid, so that the key height can be reduced on the one hand, and the mold manufacturing is facilitated on the other hand. The silica gel cushion 7 is arranged in the valve core liquid inlet through hole 30. The silica gel cushion 7 can seal a gap between an opening in the lower end of the valve core 3 and a big bottle to be filled with liquid very well and buffers pressure applied to the bottle to be filled with liquid. A through hole 71 for passing of liquid is formed in the silica gel cushion 7. There should be no restriction on the need for the silica gel cushion 7. It is also possible to change the shape of the valve core liquid inlet through hole 30 in the inner sleeve 33 so that the valve core liquid inlet through hole 30 is easily aligned with the large bottle to be filled with liquid. The valve core 3 with the valve core liquid inlet through hole 30, which can realize a liquid filling function, shall be covered in the protection scope of the invention.

Figure 3:
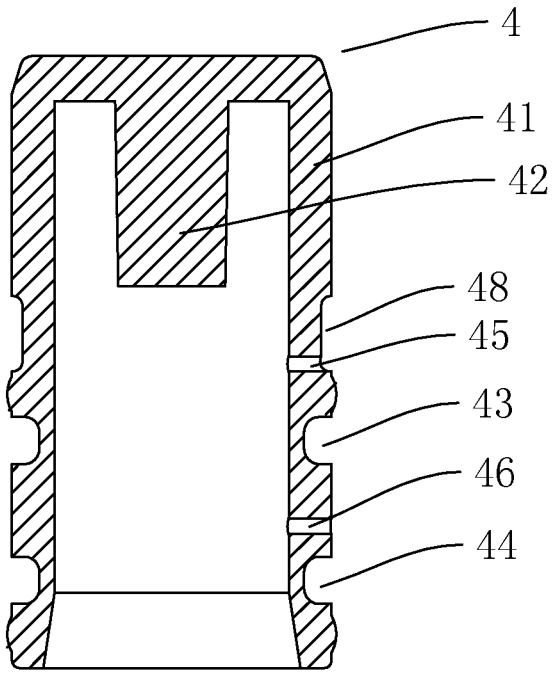
FIG. 3 is a sectional diagram of a structure of a valve bush.

The FIG. 3 is the structure of the valve bush 4 of the invention. The valve bush 4 is of an integrated structure. The valve bush 4 comprises the barrel-shaped valve bush shell 41. The valve bush limiting column 42 is arranged at the center of the inner top surface of the valve bush shell 41 and is used for defining the up stroke of the valve core 3. The valve bush limiting column 42 can be matched with the valve core limiting column (when the valve core limiting column is arranged). The valve bush liquid filling port 45 is formed in the middle part of the valve bush shell 41, a ring of ring grooves 48 are formed in the periphery position where the valve bush liquid filling port 45 is located, and the recesses of the ring grooves 48 can ensure that the valve bush liquid filling port 45 is communicated with the bottle body 2. The ring groove 48 can be omitted, and the omitting of the ring groove 48 does not affect the realization of the liquid filling function. The valve bush exhaust port 46 is formed below the valve bush liquid filling port 45. The valve bush liquid filling port 45 and the valve bush exhaust port 46 can be in any shape; and preferably, the valve bush liquid filling port 45 and the valve bush exhaust port 46 are rectangular or ovaloid, so that the key height can be reduced on the one hand, and the mold manufacturing is facilitated on the other hand. A first sealing ring groove 43 and a second sealing ring groove 44 are respectively formed in the two sides of the valve bush exhaust port 46 below the valve bush liquid filling port 45. Multiple sealing ribs 9 are arranged on the valve bush 4 and are used for being connected to other parts.

Figure 4:
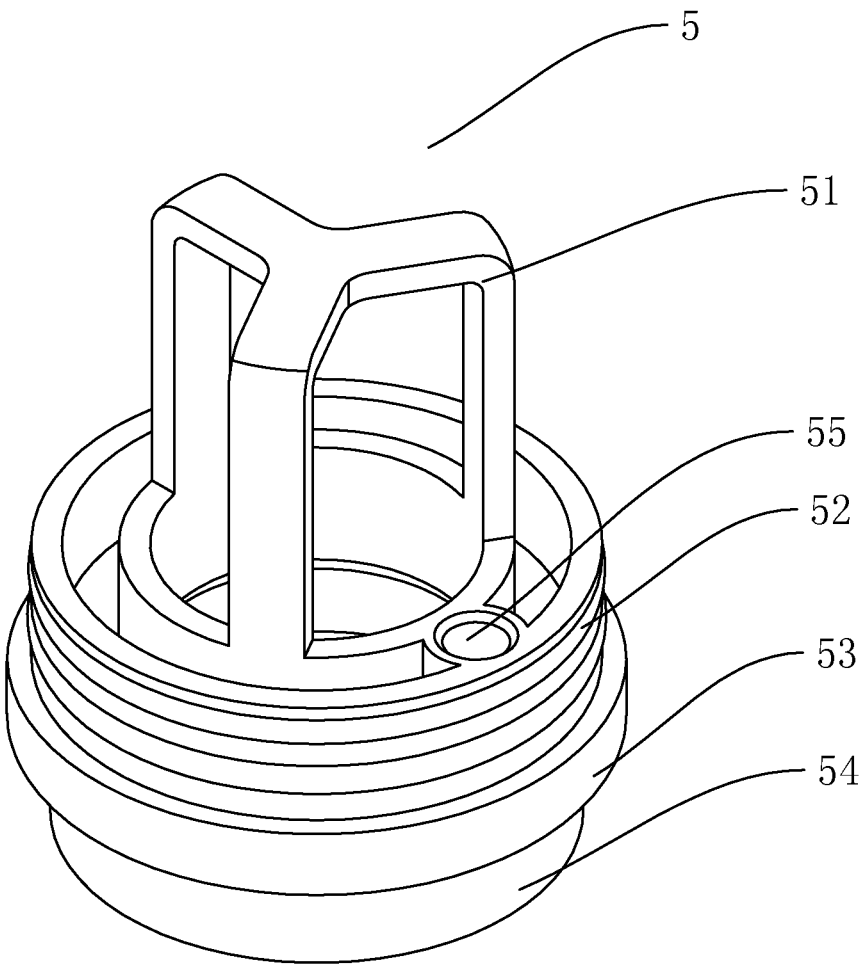
FIG. 4 is a stereoscopic diagram of a structure of a valve seat.

The FIG. 4 is the structure of the valve seat 5 of the invention. The valve seat 5 is of an integrated structure. The holding frame 51 is arranged at the upper end of the valve seat 5 in order to connect the valve bush 4 with the valve seat 5 very well. The holding frame 51 in the embodiment consists of three support frames which are uniformly distributed along the periphery and are converged toward the center of a circle. The shape of the holding frame 51 shall not be limited to this; the holding frame 51 may consist of two support frames; and the valve seat 5 with the holding frame 51, which realizes a positioning and/or assembly function, shall be within the protective scope of the invention. The valve seat 5 further comprises a valve seat table 52, and the valve seat table 52 is used for sealing connection between the valve seat 5 and the bottle body. The valve seat exhaust hole 55 is formed between the valve seat table 52 and the holding frame 51, and the exhaust pipe 21 can be inserted into the upper part of the valve seat exhaust hole 55 in a sealing manner. Preferably, during connection, the exhaust pipe 21 is connected to the opening of the valve seat exhaust hole 55 in a wedge-type seal manner. The exhaust pipe 21 becomes tighter along with the further insertion of the exhaust pipe 21 in the wedge-shaped hole of the valve seat exhaust hole 55, so that liquid can be prevented from leaking from the connected part, and the sealing effect is good. The height of the exhaust pipe 21 can be increased so as to increase liquid containing capacity, and a space is left while the exhaust pipe 21 is heightened so as to discharge gases. During liquid filling, it shall be noted that the height of liquid in the bottle should not exceed the height of the exhaust pipe 21, so as to prevent the liquid from overflowing from the exhaust pipe 21 during liquid filling. The step 53 which is connected to the side wall surface of the bottle body 2 in a clamping manner is arranged on the side surface of the valve seat table 52; and the step 53 can adapt to different metal piece bottle bushes 22, such as a flat-bottom metal piece bottle bush 22 and a circular arc-bottom metal bottle bush 22. The lantern ring 54 which is connected to the tail cover 6 is arranged at the lower part of the valve seat table 52. The sealing ribs 9 and the buckle ribs 8 are arranged on the valve seat 5 and are used for being connected to other parts.

Figure 5:
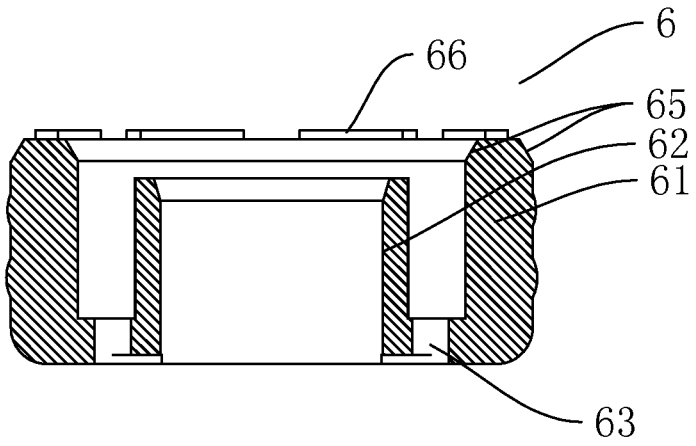
FIG. 5 is a sectional diagram of a structure of a tail cover.
Figure 6:
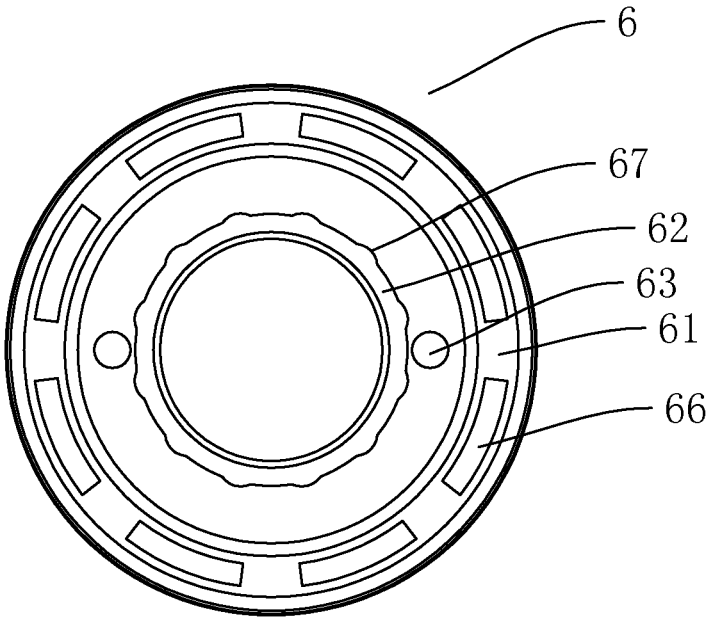
FIG. 6 is a top view of a structure of a tail cover.

The FIG. 5 and FIG. 6 are the structure of the tail cover of the invention. The tail cover 6 is of an integrated structure. The tail cover 6 comprises an outer ring 61 with the tail cover convex ribs 66, and an inner ring 62 for limiting the down stroke of the valve core 3. A ring of discontinuous tail cover convex ribs 66 narrower than the width of the top surface of the outer ring 61 of the tail cover 6 are arranged on the top surface of the outer ring 61 of the tail cover 6. The tail cover convex ribs 66 are propped against the valve seat 5; and the tail cover chamfers 65 are also formed at the two sides of the shoulder of the upper end of the tail cover 6 and can increase the exhaust space of the exhaust gap I. The outer ring 61 is connected to the bottom of the inner ring 62, is provided with the exhaust notch 63; the number of the exhaust notch 63 may be two; a plurality of exhaust notches may be uniformly distributed along the periphery; and there should be no restrictions herein. The installation gap of the valve bush 4 is reserved between the outer ring 61 and the inner ring 62. The vertical longitudinal ribs 67 for generating the exhaust gap II 64 are arranged on the periphery of the outer wall surface of the inner ring 62. Likewise, the sealing ribs 9 and the buckle ribs 8 are arranged on the tail cover 6 and are used for being connected to other parts.

The valve core 3, the valve bush 4, the valve seat 5 and the tail cover 6 are matched jointly to realize liquid filling and exhaust functions. When the silica gel cushion 7 is included, the silica gel cushion 7, the valve core 3, the valve bush 4, the valve seat 5 and the tail cover 6 are matched jointly to realize liquid filling and exhaust functions.

The realization of the liquid filling function is as follows: the valve core liquid inlet through hole 30 is formed in the valve core, and the valve core liquid filling port 35 is formed in the side wall surface of the valve core 3 and is communicated with the valve core liquid inlet through hole 30. The valve bush liquid filling port 45 is formed in the valve bush 4 and is communicated with the interior of the bottle body 2. During stillness, the valve bush liquid filling port 45 is sealed by the valve core 3. During liquid filling, the valve core 3 moves upwards in the valve bush 4, the valve bush liquid filling port 45 is opened and is communicated with the valve core liquid filling port 35 through the recess 34 formed in the valve core 3. Thus, liquid enters the valve core liquid filling port 35 from the valve core liquid inlet through hole 30, enters the valve bush liquid filling port 45 through the recess 34 and then directly enters the interior of the bottle body 2.

The realization of the exhaust function is as follows: the valve seat exhaust hole 55 is formed in the valve seat 5, and an exhaust pipe 21 is connected to the valve seat exhaust hole 55 in a sealing manner and is communicated with upper gas of the bottle body. The top surface of the tail cover 6 is provided with a ring of discontinuous tail cover convex ribs 66 narrower than the width of the top surface of the tail cover 6, and an exhaust gap I 68 is formed between the top end of the tail cover and the lower surface of the valve seat. The longitudinal ribs 67 are arranged on the outer wall of the inner ring 62 of the tail cover 6 and cause the exhaust gap II 64 to be formed between the inner ring 62 and the valve bush 4. The exhaust pipe 21, the valve seat exhaust hole 55, the exhaust gap I 68, the valve bush exhaust port 46 and the exhaust gap II 64 are communicated from head to tail to form an exhaust passage jointly. During stillness, the valve bush exhaust port 46 is sealed by the lower half part of the valve core 3, and the exhaust passage is obstructed; and during liquid filling, the valve core 3 moves upwards in the valve bush 4, the valve bush exhaust port 46 is opened, the exhaust passage is communicated with the exhaust notch 63 at the bottom of the tail cover 6, and the exhaust notch 3 is naturally communicated with atmosphere. The invention is provided with a new exhaust area, so that the functional structure is relatively compact, and the effective containing space of liquid is further increased.

The holding frame 51 is arranged at the upper end of the valve seat 5 and is used for fixing the position of the valve bush 4. Thus, the valve bush 4 is prevented from being pushed out. Meanwhile, the valve bush 4, the valve seat 5 and the tail cover 6 are connected very well to form a new "valve body", so that the valve seat exhaust hole 55, the exhaust gap I 68, the valve bush exhaust port 46 and the exhaust gap II 64 are communicated with one another to form a new exhaust passage.

Figure 7:
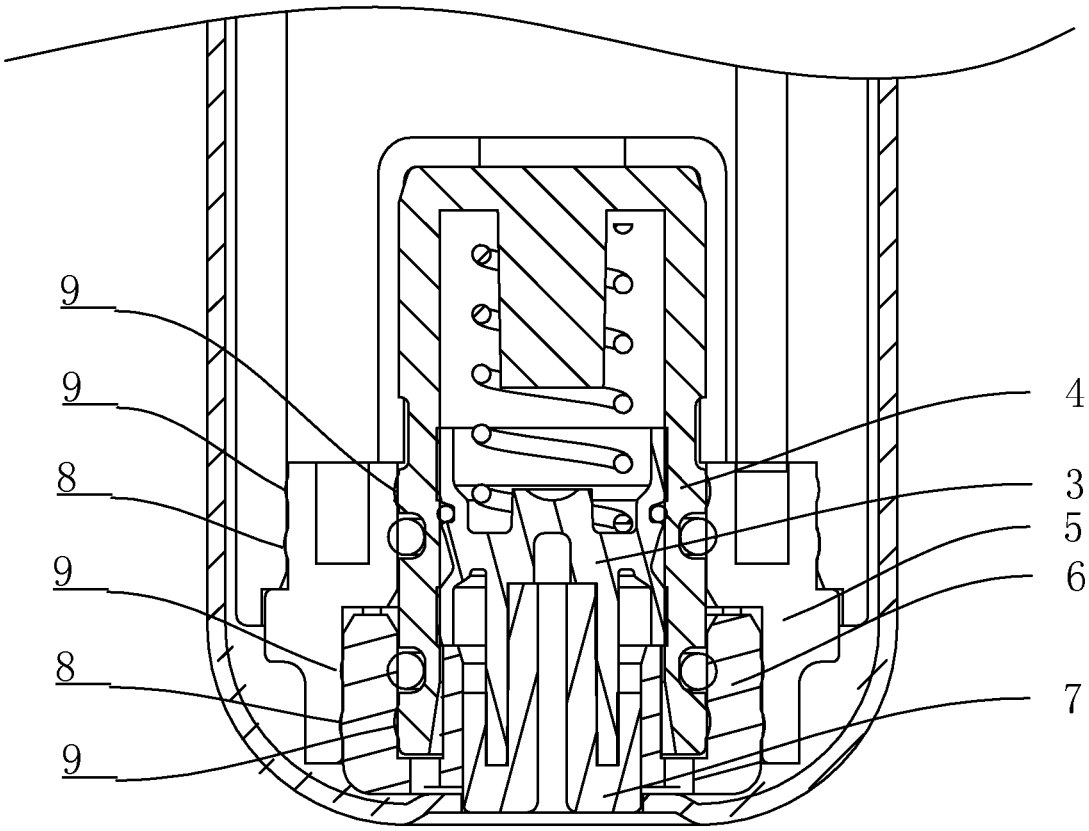
FIG. 7 is a schematic diagram of an initial filling position state after the liquid spraying bottle is installed.

As shown in FIG. 7, during installation, in order to solve the problems that the O-shaped sealing rings at the connected part of the parts have large dimensional deviation and a poor sealing effect, the valve bush 4 is connected to the tail cover 6 by arranging the sealing ribs 9 and the O-shaped rings in a double seal manner, the valve seat 5 is connected to the tail cover 6 by arranging the sealing ribs 9 and the buckle ribs 8 in a double seal manner under the combined action, the valve bush 4 is connected to the valve seat 5 by arranging the sealing ribs 9 and the O-shaped rings in a double seal manner, and the valve seat 5 is connected to the valve body 2 by arranging the sealing ribs 9 and the buckle ribs 8 in a double seal manner the under combined action. According to the invention, the sealing ribs 9 are used for sealing, the buckle ribs 8 are used for sealing the parts and preventing the dropping among the parts, the structure design is relatively reasonable, the manufacturing is relatively convenient for workers, and the production quality is stable.

Figure 8:
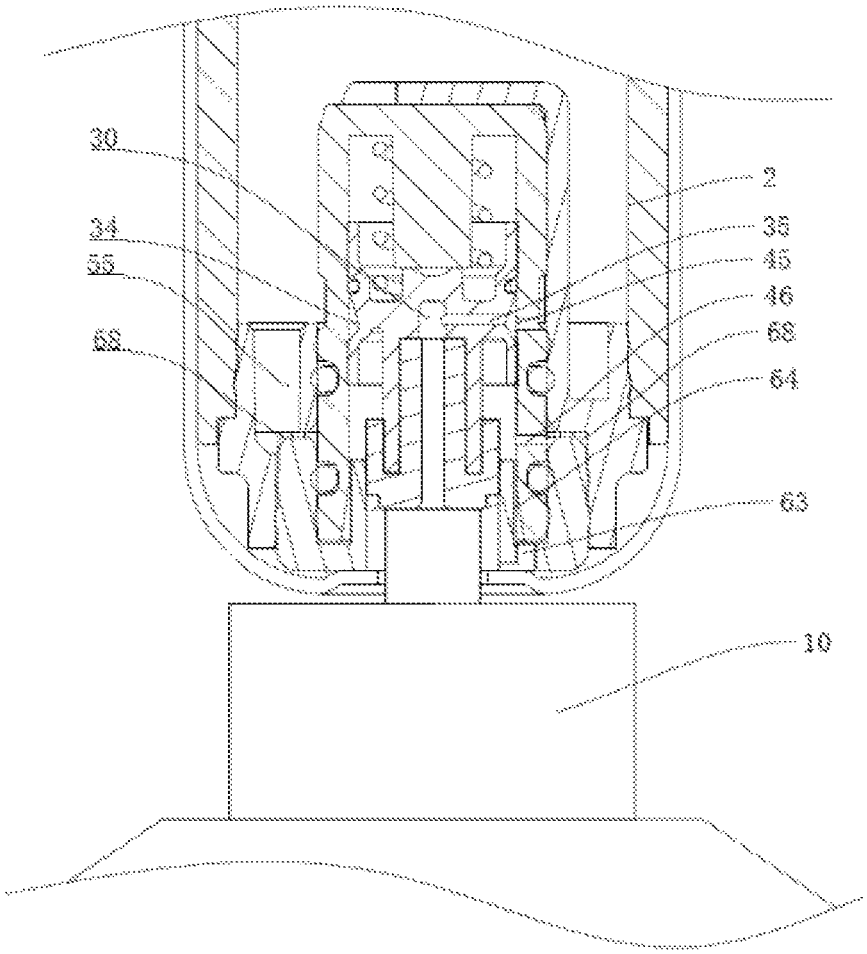
FIG. 8 is a state schematic diagram of a stop position state of the liquid spraying bottle.

As shown in FIG. 8, during liquid filling, a spray nozzle of an external large perfume bottle 10 to be filled with liquid is aligned with the liquid filling port of the bottle bottom, and then the liquid spraying bottle of the invention is pressed downwards, so that the valve core 3 rises to compress the spring 47, the upper convex ring 31 rises, the valve bush liquid filling port 45 positioned at the original position of the upper convex ring 31 is opened, the spring 47 is compressed to the maximum compression position, the valve bush liquid filling port 45 passes through the recess 34 to be communicated to the valve core liquid filling port 35 rising in place. Meantime, the valve core liquid inlet through hole 30, the valve core liquid filling port 35, the recess 34, the valve bush liquid filling port 45 and the bottle body 2 are communicated to form the whole liquid inlet passage, and liquid in the large bottle enters the bottle body 2 under the pressure effect of a pump head in the large bottle.

Meanwhile, after liquid in the large bottle enters the bottle body 2, gas in the bottle body 2 is compressed to cause the increasing of the gas pressure in the bottle, and therefore, the gas in the bottle body 2 needs to be discharged so as to ensure the continuous liquid charging. During the above liquid filling, the lower convex ring 32 moves upwards at the same time, and the valve bush exhaust port 46 is opened. For the time being, the exhaust pipe 21, the valve seat exhaust hole 55, the exhaust gap I 68, the valve bush exhaust port 46, the exhaust gap II 64 and the exhaust notch 63 are communicated to form the whole exhaust passage. The gas in the bottle is compressed to cause the increasing of pressure intensity, and is discharged through the whole exhaust passage.

After liquid filling is completed, the spray nozzle of the large bottle is loosened, the valve core 3 quickly returns under the action of the spring 47, and the upper convex ring 31 and the lower convex ring 32 continue to form sealing relationships respectively with the valve bush liquid filling port 45 and the valve bush exhaust port 45 so as to prevent liquid in the bottle body 2 from leaking outwards.

REFERENCE SIGN LISTING

1. spraying head assembly
2. bottle body

21. exhaust pipe
22. metal piece bottle bush
3. valve core
30. valve core liquid inlet hole
31. upper convex ring
311. sealing groove;
312. O-shaped sealing ring
32. lower convex ring
33. inner sleeve
34. recess
35. valve core liquid filling port
4. valve bush
41. valve bush shell
42. valve sleeve limiting column
43. first sealing ring groove
44. second sealing ring groove
45. valve bush liquid filling port
46. valve bush exhaust port
47. spring
48. ring groove
5. valve seat
51. holding frame
52. valve seat table
53. step
54. lantern ring
55. valve seat exhaust hole
6. tail cover
61. outer ring
62. inner ring
63. exhaust notch
64. exhaust gap II
65. tail cover chamfer
66. tail cover convex rib
67. longitudinal rib
68. exhaust gap I
7. silica gel cushion
71. through hole
8. buckle rib
9. sealing rib
10. large perfume bottle

The invention claimed is:

1. A compact liquid spraying bottle filled liquid from the bottom, comprising a spraying head assembly, a bottle body and a liquid filling and exhaust function assembly arranged at a bottom of the bottle body, wherein the spraying head assembly is arranged at an upper part of the bottle body;

wherein the liquid filling and exhaust function assembly comprises: a valve core, a valve bush, a valve seat and a tail cover which are matched jointly to realize liquid filling and exhaust functions; the valve core is inserted in the valve bush, and a spring is arranged between a top end of the valve core and an inner cavity of the valve bush; during liquid filling, the valve core moves upwards in the valve bush and resets through the spring; the valve seat is sleeved at an outer side of the valve bush, a gap is reserved at a lower end of a connected part of the valve bush and the valve seat, and the tail cover is inserted in the gap; and the tail cover is of an integrated structure and comprises an outer ring provided with tail cover convex ribs, and an inner ring used for limiting a down stroke of the valve core and provided with longitudinal ribs on a periphery of an outer wall, and an exhaust notch is formed at a connected bottom of the outer ring and the inner ring.

2. The compact liquid spraying bottle with a bottom filled with liquid according to claim 1, wherein the liquid filling and the exhaust are respectively performed as follows:

the liquid filling: a valve core liquid inlet through hole is formed in the valve core, and a valve core liquid filling port is formed in a side wall of the valve core and communicated with the valve core liquid inlet through hole; a valve bush liquid filling port is formed in the valve bush and communicated with an interior of the bottle body;

the exhaust: a valve seat exhaust hole is formed in the valve seat, and an exhaust pipe is connected to the valve seat exhaust hole in a sealing manner and communicated with an upper gas of the bottle body; a top surface of the tail cover is provided with a ring of discontinuous tail cover convex ribs narrower than a width of the top surface of the tail cover, and an exhaust gap I is formed between the top end of the tail cover and the lower surface of the valve seat;

the longitudinal ribs are arranged on an outer wall of the inner ring of the tail cover and cause an exhaust gap II to be formed between the inner ring and the valve bush; the exhaust pipe, the valve seat exhaust hole, the exhaust gap I, a valve bush exhaust port and the exhaust gap II are communicated from head to tail to form an exhaust passage jointly.

3. The compact liquid spraying bottle with a bottom filled with liquid according to claim 1, wherein the valve core is of an integrated structure and comprises an upper convex ring for sealing a valve bush liquid filling port, a lower convex ring for sealing a valve bush exhaust port, an inner sleeve located in the lower convex ring and provided with a valve core liquid inlet through hole, and a silica gel cushion located in the valve core liquid inlet through hole and provided with a through hole; and a recess for filling liquid is formed between the upper convex ring and the lower convex ring, and the valve core liquid filling port is formed in a middle position of the recess.

4. The compact liquid spraying bottle with a bottom filled with liquid according to claim 3, wherein the valve core is also provided with a sealing groove and an O-shaped sealing ring which are used for enhancing the sealing of the valve bush liquid filling port.

5. The compact liquid spraying bottle with a bottom filled with liquid according to claim 3, wherein the valve bush is of an integrated structure and comprises a barrel-shaped valve bush shell, a valve bush limiting column located in a center of an inner top surface of the valve bush shell and used for defining an up stroke of the valve core, the valve bush liquid filling port located in the middle of the valve bush shell, and the valve bush exhaust port located below the valve bush liquid filling port; and a first sealing ring groove and a second sealing ring groove are respectively formed in two sides of the valve bush exhaust port.

6. The compact liquid spraying bottle with a bottom filled with liquid according to claim 5, wherein the valve seat is of an integrated structure and comprises a holding frame used for assembling the valve bush, a valve seat table connected to the bottle body and a valve seat exhaust hole for installing an exhaust pipe, wherein a step connected to the bottle body in a clamping manner is arranged on a side surface of the valve seat table, and a lower part of the valve seat table is provided with a lantern ring connected to the tail cover.

7. The compact liquid spraying bottle with a bottom filled with liquid according to claim 6, wherein holes of the valve core liquid filling port, the valve bush liquid filling port and the valve bush exhaust port are rectangular or ovaloid and prolate.

* * * * *